US007375693B2

(12) United States Patent
Ikeda et al.

(10) Patent No.: US 7,375,693 B2
(45) Date of Patent: May 20, 2008

(54) IN-VEHICLE ANTENNA APPARATUS

(75) Inventors: Tomoki Ikeda, Fukushima-ken (JP); Hideaki Oshima, Ibaraki-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 0 days.

(21) Appl. No.: 11/159,829

(22) Filed: Jun. 23, 2005

(65) Prior Publication Data

US 2006/0028382 A1 Feb. 9, 2006

(30) Foreign Application Priority Data

Jun. 25, 2004 (JP) ..... 2004-188722

(51) Int. Cl.
*H01Q 1/32* (2006.01)

(52) U.S. Cl. ..... 343/713

(58) Field of Classification Search ..... 343/711, 343/713

See application file for complete search history.

(56) References Cited

U.S. PATENT DOCUMENTS 4,785,305 A * 11/1988 Shyu ..... 343/713
4,916,456 A * 4/1990 Shyu ..... 343/713
6,005,527 A 12/1999 Gomez
6,164,984 A 12/2000 Schreiner
6,307,515 B1 10/2001 Sauer et al.
6,411,259 B1 6/2002 Wendt et al.

FOREIGN PATENT DOCUMENTS

DE 298 18 813 1/1999
JP 05-191124 7/1993
JP 06-053722 2/1994

* cited by examiner

*Primary Examiner*—Michael C. Wimer
(74) *Attorney, Agent, or Firm*—Brinks Hofer Gilson & Lione

(57) ABSTRACT

A sheet of glass (rear glass) is provided with a radiation conductor and a ground conductor. An electronic circuit unit includes a base plate fixed on the sheet of glass; a frame body which houses a circuit substrate and is screwed on the base plate; and a cover for covering the frame body. The circuit substrate has a component-holding surface and a radio-wave reflective surface at opposite surfaces of the circuit substrate, the radio-wave reflective surface facing the radiation conductor. A section of the frame body proximate the sheet of glass is provided with an engagement portion that fits in an opening of the base plate; and stoppers placed on sections of the base plate that are adjacent to the opening. An amount of insertion of the engagement portion with respect to the opening is set within a thickness of the base plate.

4 Claims, 9 Drawing Sheets

IN-VEHICLE ANTENNA APPARATUS

This application claims the benefit of Japanese Patent Application No. 2004-188722 filed in Japan on Jun. 25, 2004, which is hereby incorporated by reference.

BACKGROUND OF THE INVENTION

1. Field of the Invention

The present invention relates to an in-vehicle antenna apparatus mounted on a windowpane of a vehicle, such as an automobile, and particularly, to an in-vehicle antenna apparatus in which a conductor layer provided on one surface of a circuit substrate of an electronic circuit unit is opposed to a radiation conductor in order to achieve a higher gain.

2. Description of the Related Art

A conventional in-vehicle antenna apparatus is provided with a radiation conductor disposed on an inner surface of rear glass or front glass of a vehicle, and an electronic circuit unit that includes a pre-amplifying circuit and that is attached to the inner surface, such that the in-vehicle antenna apparatus is capable of, for example, receiving a circularly-polarized wave or a linearly-polarized wave sent from a satellite or a ground-based station. In comparison with other types of antenna apparatuses that are set on the exterior of a vehicle, such as a roof, this type of antenna apparatus is advantageous in having a longer lifespan and a lower possibility of being stolen. Furthermore, in comparison with antenna apparatuses that are set in the vicinity of the inner surface of a windowpane of a vehicle, this type of antenna apparatus is advantageous in providing a good space factor and a wide angle of view.

In an in-vehicle antenna apparatus of this type, the electronic circuit unit attached to the inner surface of a sheet of glass, such as rear glass or front glass, facing the inside of the vehicle includes a housing that houses a circuit substrate provided with, for example, a pre-amplifying circuit. In the electronic circuit unit, a radiation conductor having a predetermined shape and disposed on the sheet of glass is electrically connected with the circuit substrate via appropriate means so that the radiation conductor can receive electricity and load a received signal.

Japanese Unexamined Patent Application Publication No. 6-53722 (p. 2 to p. 3, FIG. 1) discloses an example of such a conventional in-vehicle antenna apparatus in which a conductor segment protrudes from an insulating housing that houses a circuit substrate such that the conductor segment is soldered on an electric feeding point of a radiation conductor. Since one end of the conductor segment is connected to an input section of a pre-amplifying circuit inside the housing, the radiation conductor and the pre-amplifying circuit are electrically connected to each other via the conductor segment, and the electronic circuit unit is fixed on the sheet of glass.

In such a conventional in-vehicle antenna apparatus, however, a radiation pattern is generated not only on one side of the sheet of glass having the radiation conductor but also on the other side of the sheet of glass. This may easily lead to an insufficient gain in the desired direction. In order to solve such a problem, a conductor layer functioning as a radio-wave reflective surface may be disposed in the interior of the vehicle at a position facing the radiation conductor. In that case, however, a high gain cannot be achieved unless the distance between the radiation conductor and the conductor layer is set in a highly accurate manner.

Furthermore, in this example of a conventional in-vehicle antenna apparatus, the electronic circuit unit, which is an integrated unit, is fixed to the sheet of glass by, for example, soldering. This is problematic in view of the fact that when the circuit substrate is to be inspected or replaced with a new one, it is necessary to perform complicated processes, such as demounting the electronic circuit unit from the sheet of glass and remounting the electronic circuit unit back to the sheet of glass, and thus makes the maintenance difficult.

SUMMARY OF THE INVENTION

Accordingly, it is an object of the present invention to provide an in-vehicle antenna apparatus that is mounted on an inner surface of a windowpane of a vehicle and that allows for a high gain in a desired direction and easy maintenance.

In order to achieve the aforementioned object, the present invention provides an in-vehicle antenna apparatus which includes a sheet of glass serving as a windowpane installed in a vehicle; a radiation conductor disposed on an inner surface of the sheet of glass facing an inside of the vehicle; a sheet-metal base plate having an opening and fixed on the inner surface of the sheet of glass; a circuit substrate whose first surface faces the radiation conductor and is provided with a conductor layer and whose second surface defines a component-holding surface electrically connected with the radiation conductor; and a sheet-metal housing which houses the circuit substrate and is attached to the base plate. A section of the housing proximate the sheet of glass includes an engagement portion that loosely fits in the opening; and stoppers placed on sections of the base plate that are adjacent to the opening, the stoppers abutting on the base plate such that an amount of insertion of the engagement portion with respect to the opening is set within a thickness of the base plate.

According to this in-vehicle antenna apparatus in which the conductor layer provided on the first surface of the circuit substrate faces the radiation conductor, the conductor layer functions as a radio-wave reflective surface so that the radiation gain can be increased in the incoming direction of a tuned radio-wave. This contributes to a higher antenna performance. In this case, in view of the fact that the distance between the radiation conductor and the conductor layer must be set in a highly accurate manner, since the housing that houses the circuit substrate is positioned properly in the planar direction of the base plate via the engagement portion and in the thickness direction of the base plate via the stoppers, the circuit substrate is automatically disposed at a predetermined position when the housing is mounted onto the base plate. This means that the height of the circuit substrate is set accurately with respect to the radiation conductor, and moreover, prevents an undesired gap from being formed between the housing and the base plate. In other words, since this in-vehicle antenna apparatus is an assembly structure in which the height of the radio-wave reflective surface is set in a highly accurate manner, a high antenna performance is guaranteed. Moreover, since the housing that houses the circuit substrate is, for example, screwed on the base plate that is preliminarily fixed on the sheet of glass, it is not necessary to perform complicated processes, such as demounting and remounting processes, when the circuit substrate is to be inspected or replaced with a new one. As a result, this allows for easier maintenance.

Furthermore, according to the in-vehicle antenna apparatus, the housing preferably includes a rectangular frame body that surrounds and supports the circuit substrate and that is fixed to the base plate in a detachable manner; and a cover that engages with the frame body so as to cover the circuit substrate. Moreover, each of four corners of the frame body is preferably provided with one of the stoppers. Accordingly, the structure of the frame body is simplified so as to contribute to an easier formation of the engagement portion and the stoppers, and to achieve easier installation of the circuit substrate in the frame body before the frame body is capped with the cover. In this case, longitudinal ends of two facing side walls of the frame body may be provided with the stoppers, the stoppers being projected slightly outward with respect to side walls adjacent to the two facing side walls. This allows for the corners of the side walls to function as the stoppers, thereby contributing to easier fabrication and higher dimensional accuracy.

According to the in-vehicle antenna apparatus of the present invention, which is mounted on the inner surface of a windowpane of a vehicle, the conductor layer provided on the first surface of the circuit substrate is opposed to the radiation conductor so as to function as a radio-wave reflective surface, and the housing that houses the circuit substrate is provided with the engagement portion and the stoppers. This structure allows for the positional relationship between the sheet of glass and the circuit substrate to be set in a highly accurate manner, and prevents an undesired gap from being formed between the housing and the base plate. Furthermore, according to this in-vehicle antenna apparatus, the housing that houses the circuit substrate is, for example, screwed on the base plate that is preliminarily fixed on the sheet of glass. Accordingly, an in-vehicle antenna apparatus that allows for a high gain in a desired direction and easy maintenance is provided.

DESCRIPTION OF THE PREFERRED EMBODIMENTS

Figure 1A:
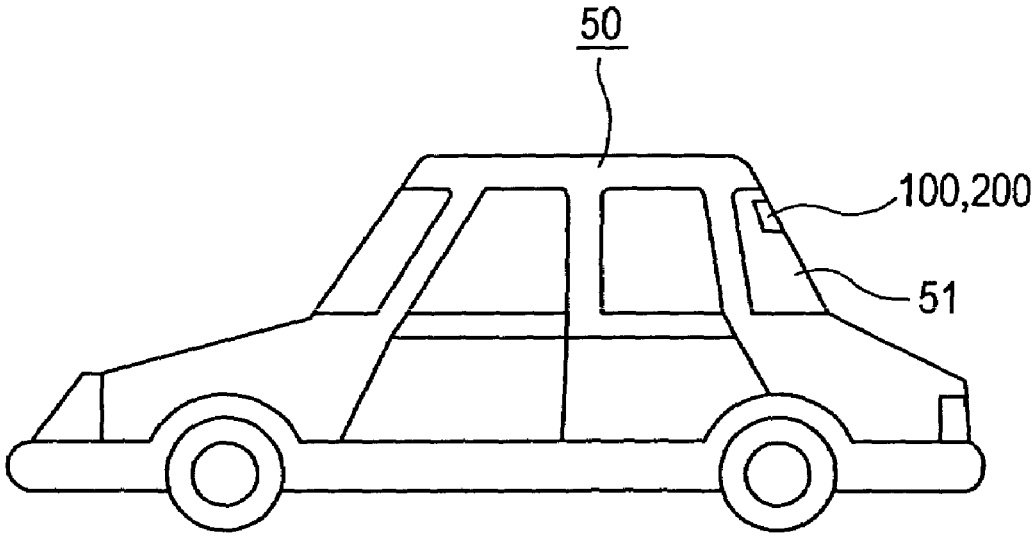
FIGS. 1A and 1B are schematic diagrams illustrating a mounting position of an in-vehicle antenna apparatus according to an embodiment of the present invention.
Figure 1B:
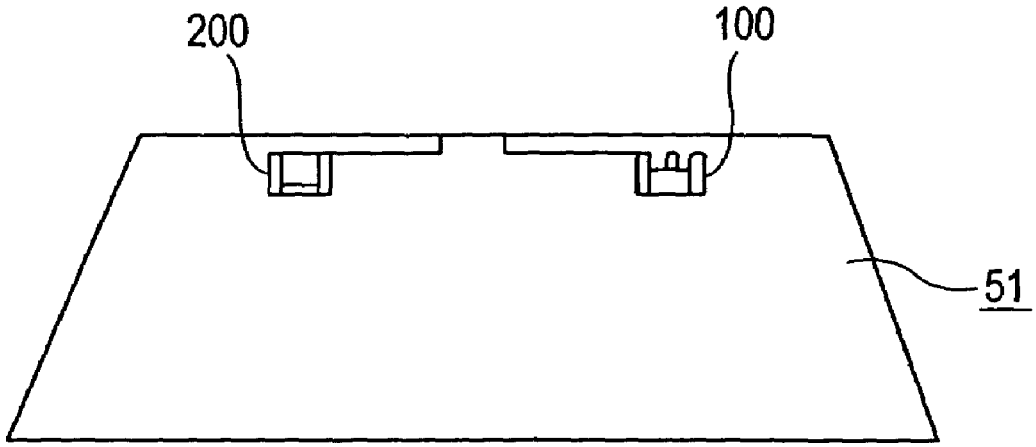
Figure 2:
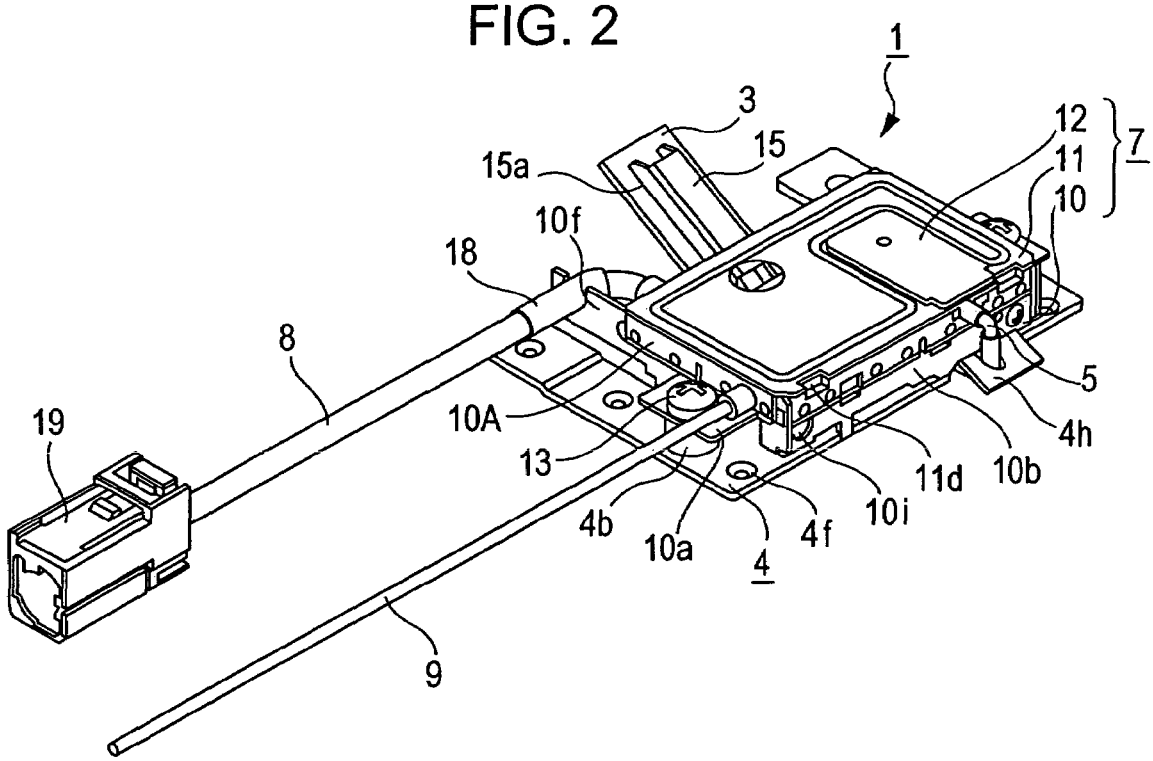
FIG. 2 is a perspective view of an electronic circuit unit of a ground-based antenna device included in the in-vehicle antenna apparatus.
Figure 3:
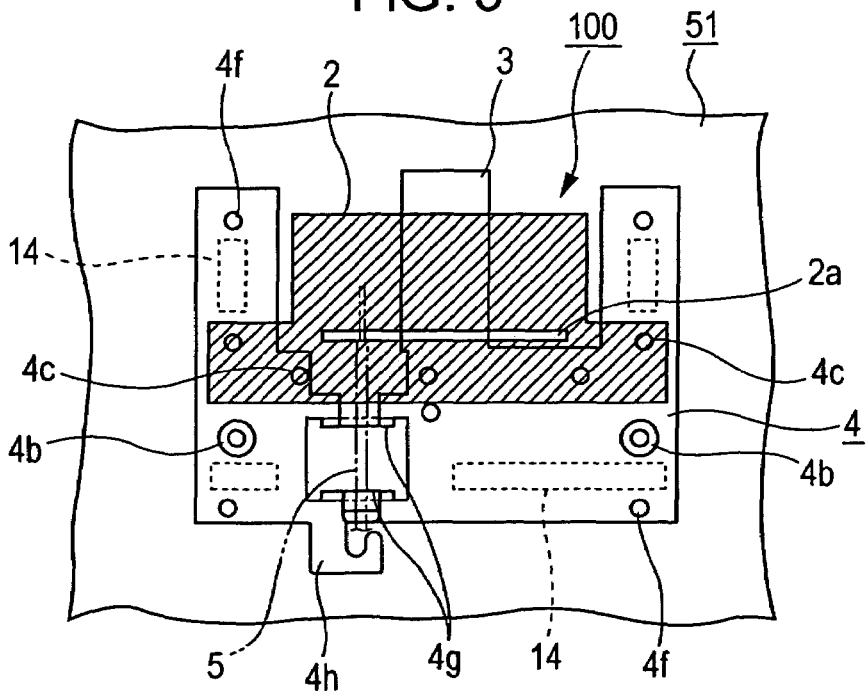
FIG. 3 is a schematic view illustrating a positional relationship between a base plate of the electronic circuit unit shown in FIG. 2 and a radiation conductor.
Figure 4:
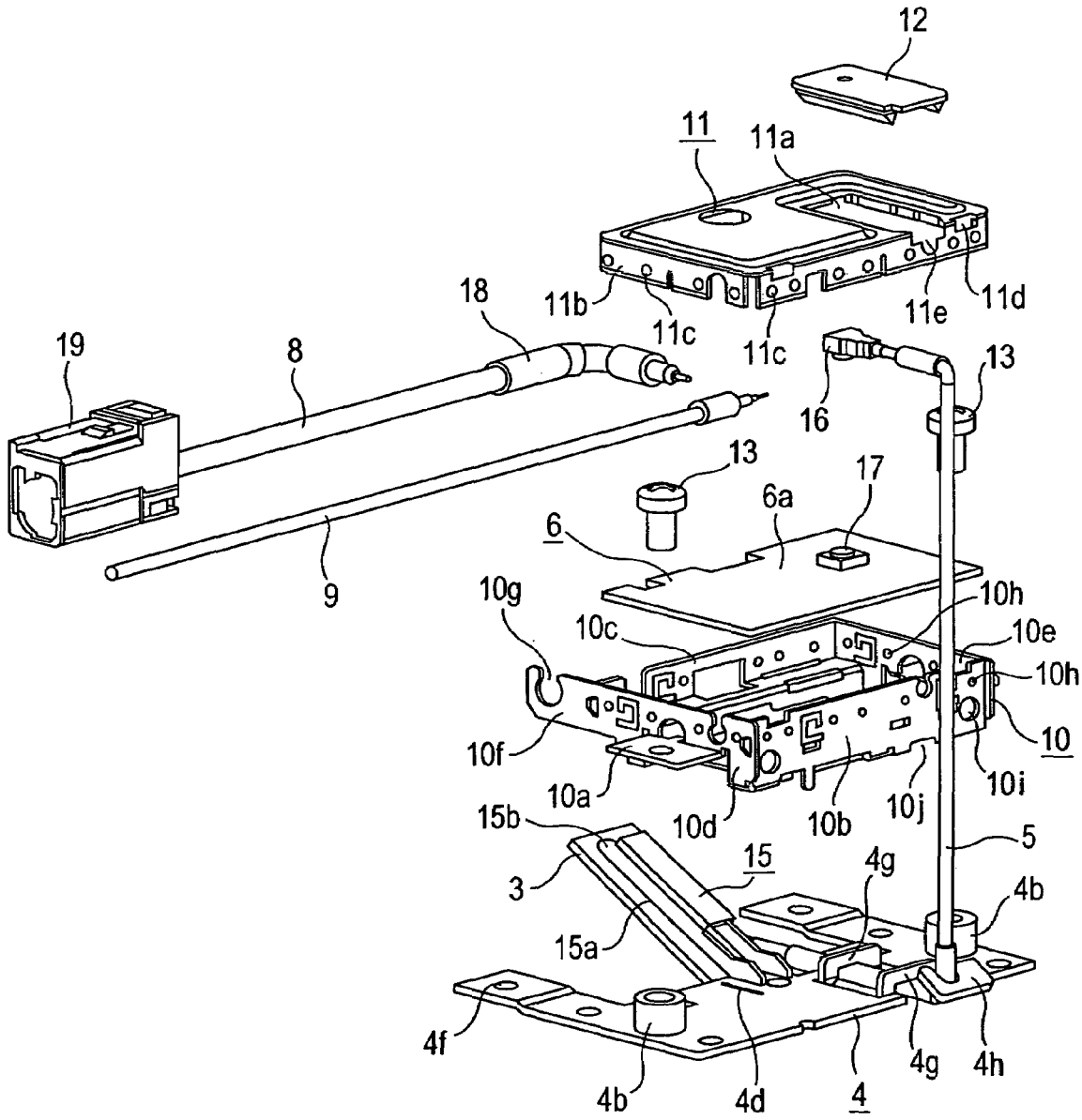
FIG. 4 is an exploded perspective view of the electronic circuit unit shown in FIG. 2.
Figure 5:
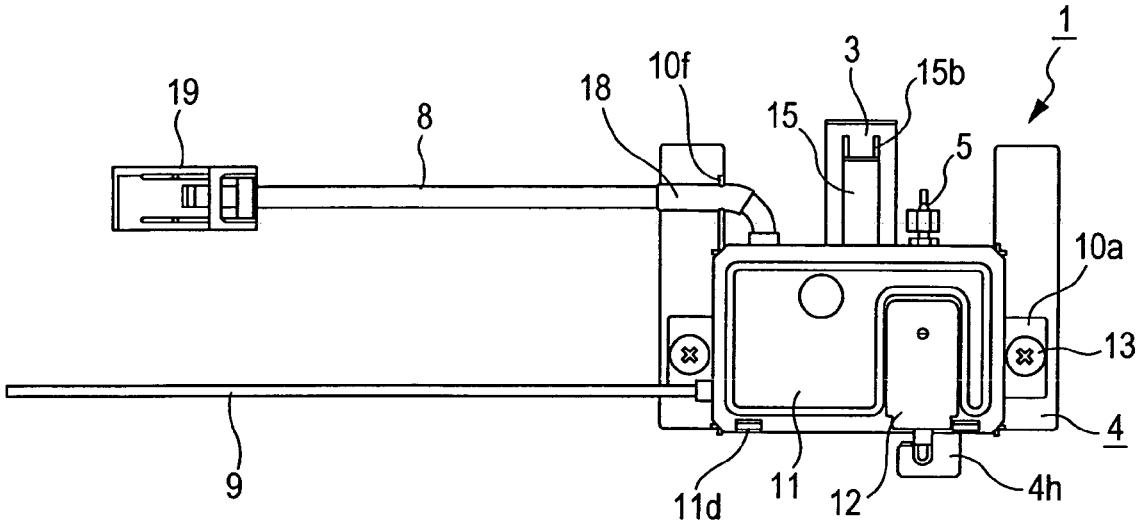
FIG. 5 is a plan view of the electronic circuit unit shown in FIG. 2.
Figure 6:
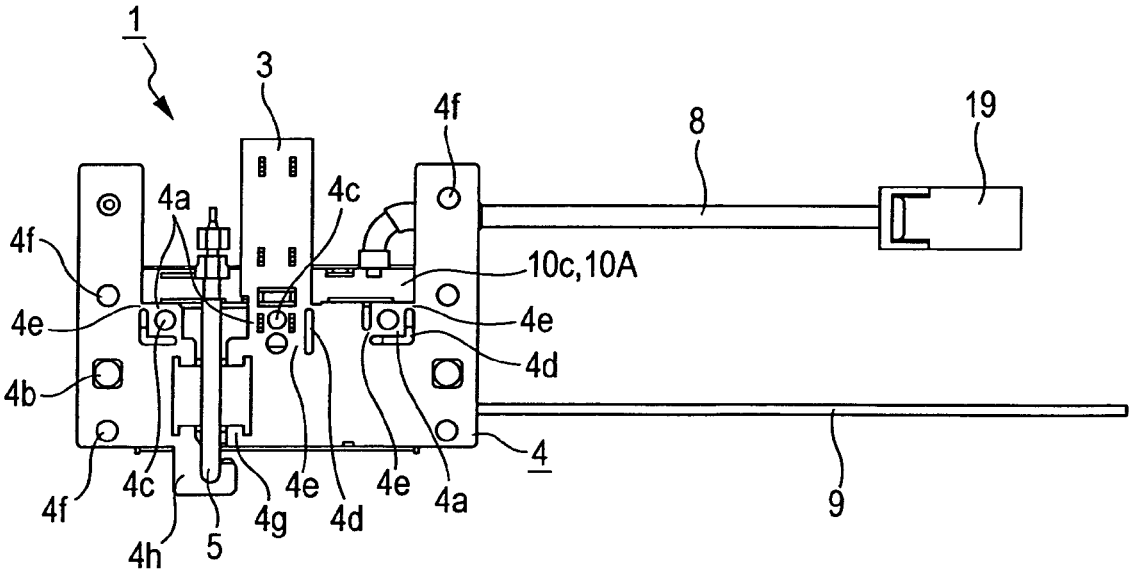
FIG. 6 is a bottom view of the electronic circuit unit shown in FIG. 2.
Figure 7:
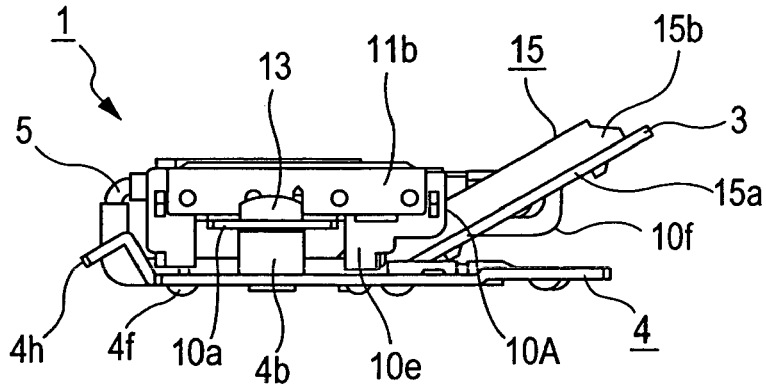
FIG. 7 is a side view of the electronic circuit unit shown in FIG. 2.
Figure 8:
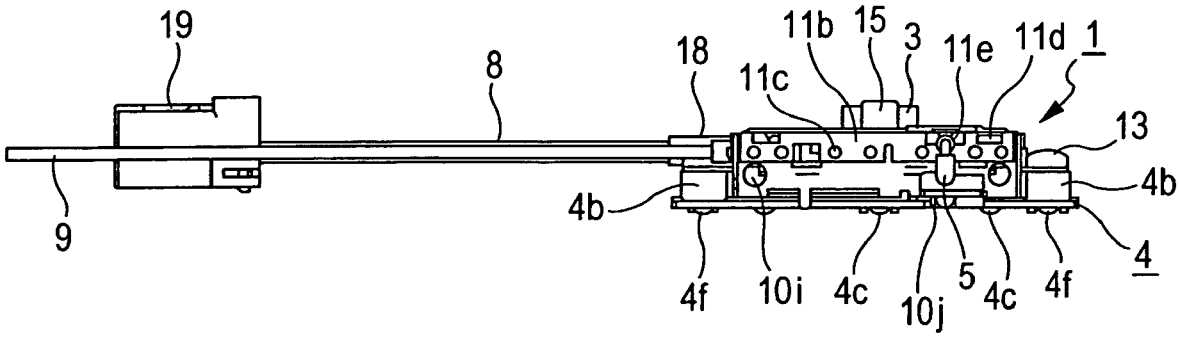
FIG. 8 is another side view of the electronic circuit unit in FIG. 2 as viewed from a side different from the side shown in FIG. 7.
Figure 9:
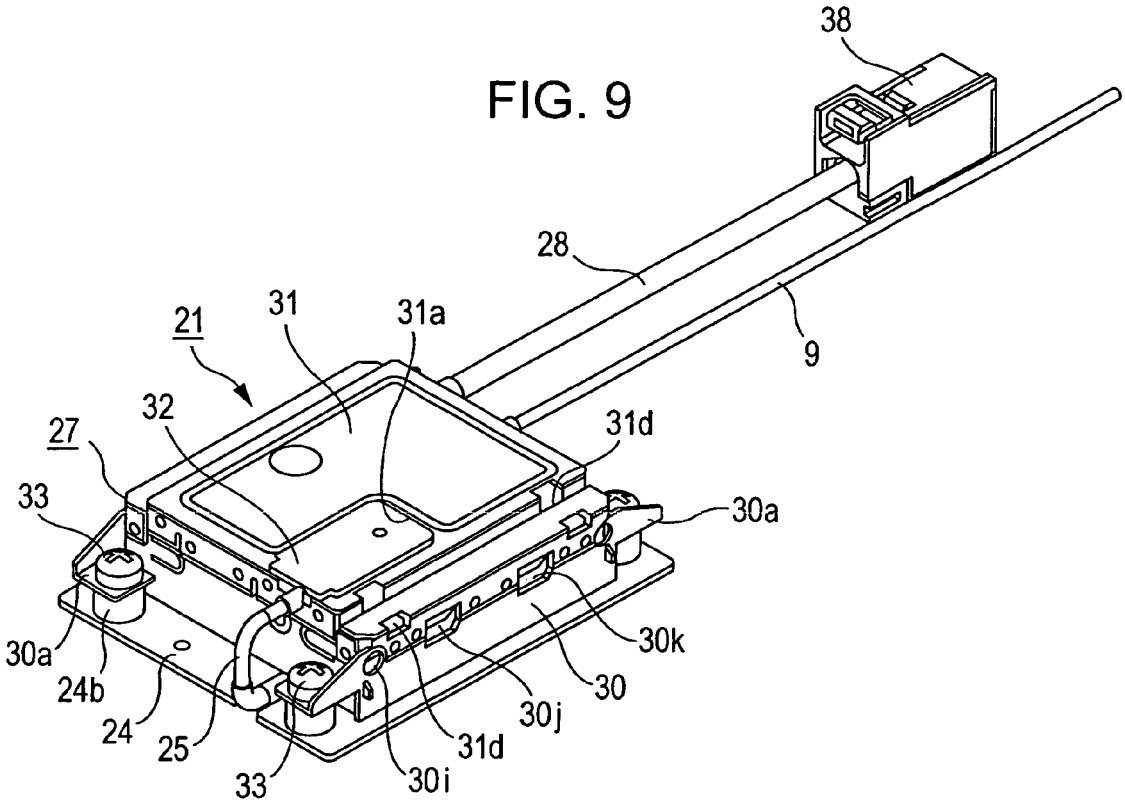
FIG. 9 is a perspective view of a satellite antenna device included in the in-vehicle antenna apparatus.
Figure 10:
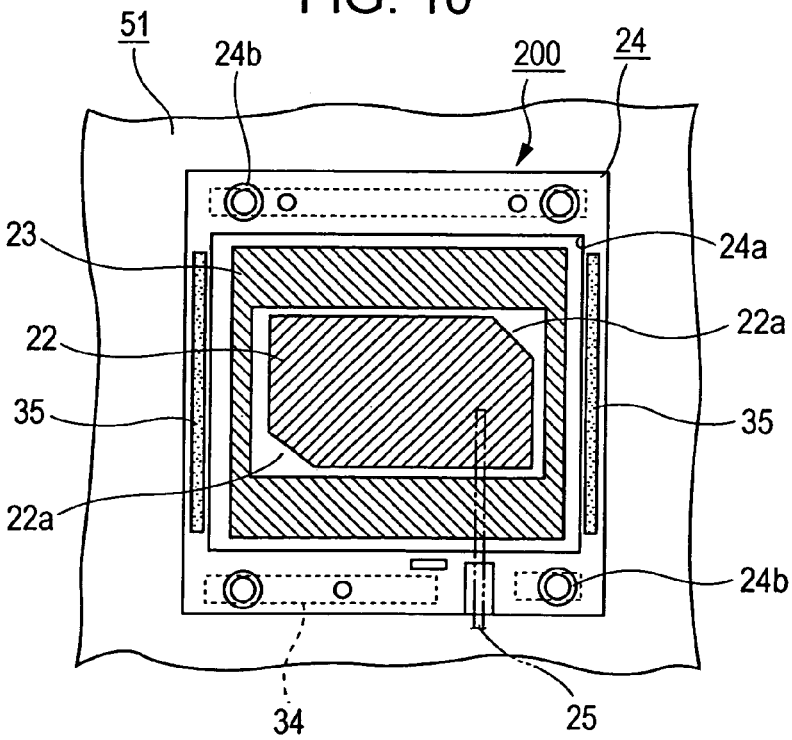
FIG. 10 is a schematic view illustrating a positional relationship between a base plate of an electronic circuit unit shown in FIG. 9 and a radiation conductor.
Figure 11:
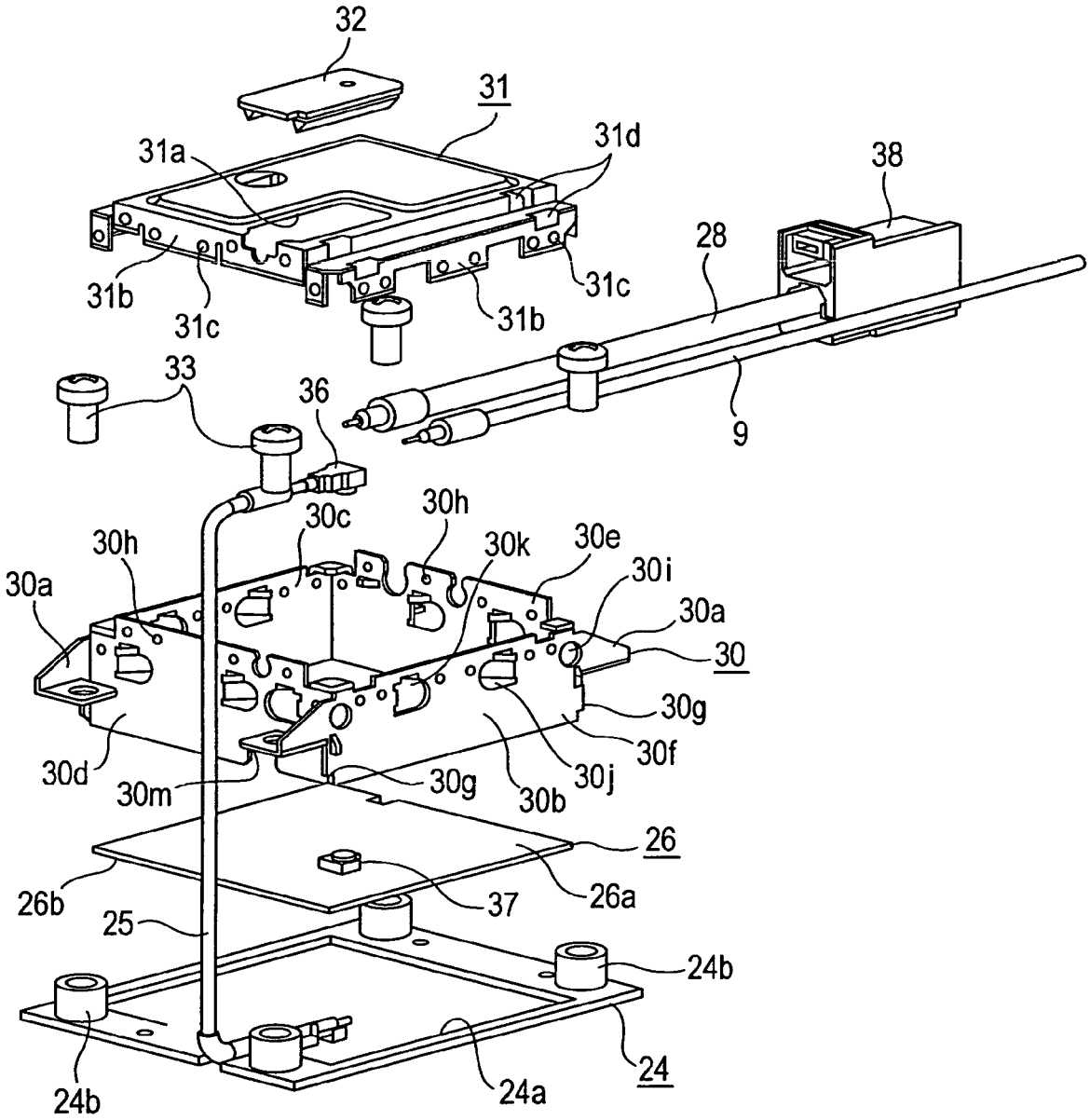
FIG. 11 is an exploded perspective view of the electronic circuit unit shown in FIG. 9.
Figure 12:
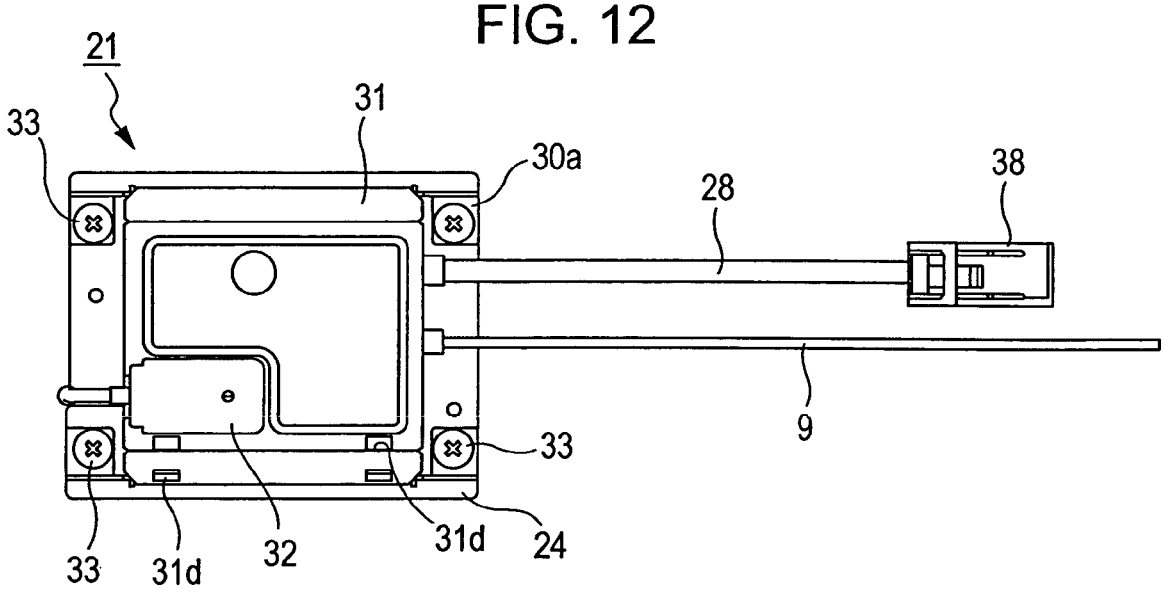
FIG. 12 is a plan view of the electronic circuit unit shown in FIG. 9.
Figure 13:
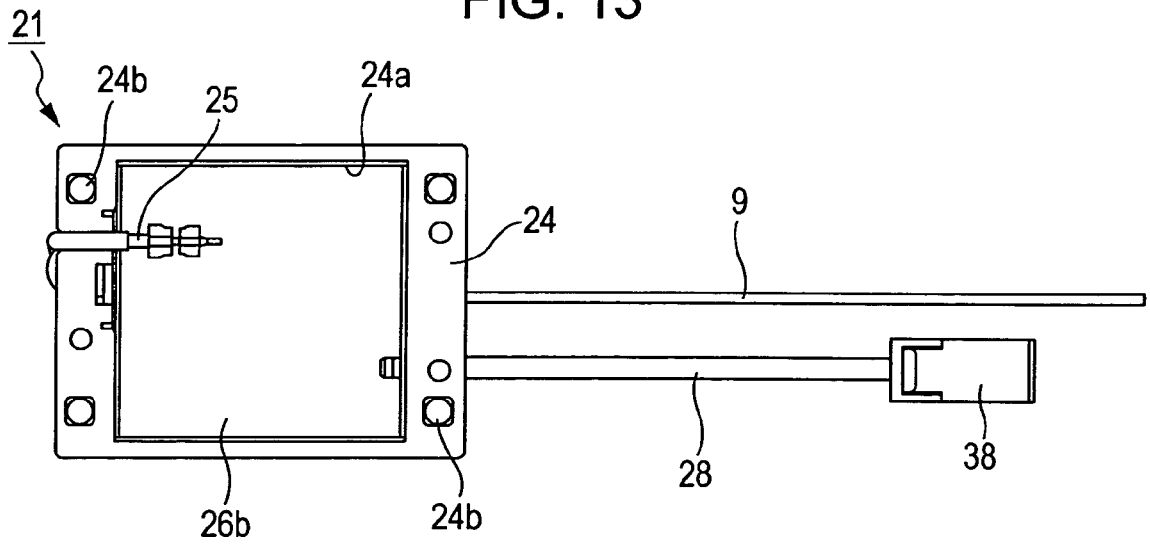
FIG. 13 is a bottom view of the electronic circuit unit shown in FIG. 9.
Figure 14:
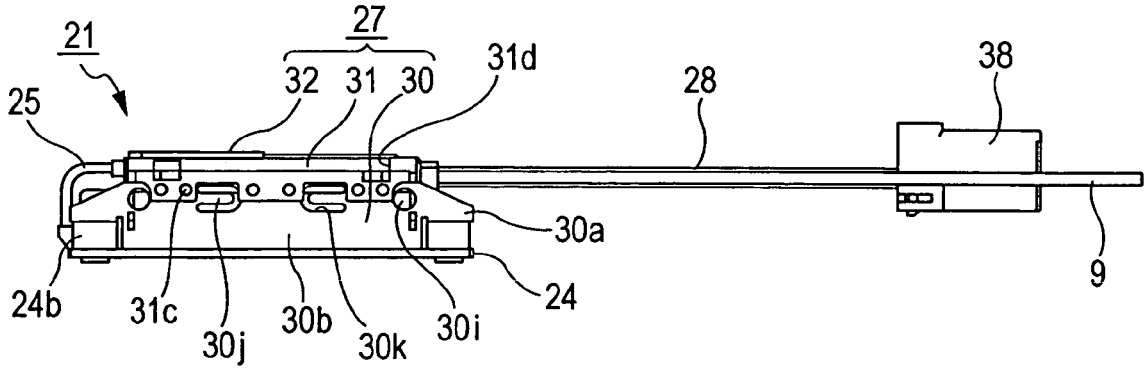
FIG. 14 is a side view of the electronic circuit unit shown in FIG. 9.
Figure 15:
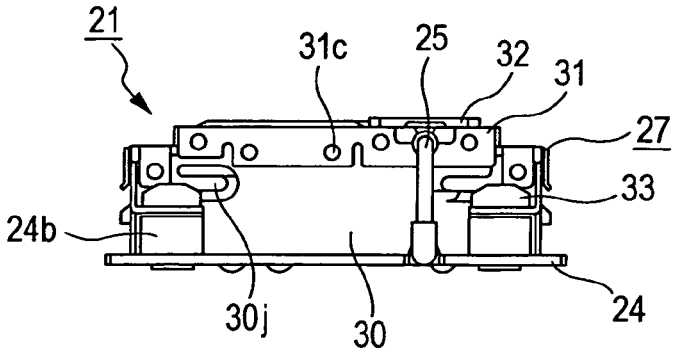
FIG. 15 is another side view of the electronic circuit unit in FIG. 9 as viewed from a side different from the side shown in FIG. 14.

Embodiments of the present invention will now be described with reference to the drawings. FIGS. 1A and 1B are schematic views illustrating a mounting position of an in-vehicle antenna apparatus according to an embodiment of the present invention. Specifically, FIG. 1A is a side view of a vehicle, and FIG. 1B is a front view of rear glass as viewed from the inside of the vehicle. FIGS. 2 to 8 illustrate a ground-based antenna device 100 included the in-vehicle antenna apparatus. FIG. 2 is a perspective view of an electronic circuit unit 1 provided in the ground-based antenna device 100. FIG. 3 is a schematic view illustrating a positional relationship between a base plate 4 of the electronic circuit unit 1 and a radiation conductor 2. FIG. 4 is an exploded perspective view of the electronic circuit unit 1. FIG. 5 is a plan view of the electronic circuit unit 1. FIG. 6 is a bottom view of the electronic circuit unit 1. FIG. 7 is a side view of the electronic circuit unit 1. FIG. 8 is another side view of the electronic circuit unit 1 as viewed from a side different from the side shown in FIG. 7. In FIG. 8, a coaxial feeder cable 5 and a connector cover 12 are not shown. On the other hand, FIGS. 9 to 15 illustrate a satellite antenna device 200 included in the in-vehicle antenna apparatus. Specifically, FIG. 9 is a perspective view of an electronic circuit unit 21 provided in the satellite antenna device 200. FIG. 10 is a schematic view illustrating a positional relationship between a base plate 24 of the electronic circuit unit 21 and a radiation conductor 22. FIG. 11 is an exploded perspective view of the electronic circuit unit 21. FIG. 12 is a plan view of the electronic circuit unit 21. FIG. 13 is a bottom view of the electronic circuit unit 21. FIG. 14 is a side view of the electronic circuit unit 21. FIG. 15 is another side view of the electronic circuit unit 21 as viewed from a side different from the side shown in FIG. 14.

Referring to FIGS. 1A and 1B, the in-vehicle antenna apparatus according to this embodiment includes the ground-based antenna device 100 and the satellite antenna device 200 which are arranged substantially in a side-by-side manner on an inner surface of rear glass 51 facing the inside of a vehicle 50. The ground-based antenna device 100 is capable of receiving a linearly-polarized wave (i.e. a vertically polarized wave) sent from a ground-based station, whereas the satellite antenna device 200 is capable of receiving a circularly-polarized wave sent from a satellite. The in-vehicle antenna apparatus operates the ground-based antenna device 100 and the satellite antenna device 200 in a mutually complementary manner so as to constantly achieve a good reception.

The ground-based antenna device 100 will first be described with reference to FIGS. 2 to 8. The ground-based antenna device 100 is a slot antenna device and mainly includes the electronic circuit unit 1 attached to the inner surface of the rear glass 51 facing the inside of the vehicle 50, and the radiation conductor 2 disposed on the inner surface of the rear glass 51. The electronic circuit unit 1 includes the base plate 4 formed of a sheet metal, which is fixed on the inner surface of the rear glass 51 and is provided with a projecting reflector plate 3; a circuit substrate 6 electrically connected with the radiation conductor 2 via the coaxial feeder cable 5; a sheet-metal housing 7 that houses the circuit substrate 6 and is attached to the base plate 4; a coaxial cable (output cable) 8 whose first end is connected to the circuit substrate 6 and whose second end is connected to an external receiving unit (not shown); and a DC cable 9 for power supply.

The housing 7 includes a sheet-metal frame-body 10 that surrounds and supports the circuit substrate 6; a sheet-metal cover 11 that is engaged with the frame body 10 so as to cover the circuit substrate 6; and a sheet-metal connector-cover 12 for covering an opening 11*a* of the cover 11. Two projecting sections of the frame body 10, namely, two projection tabs 10*a*, are fixed to the base plate 4 via setscrews 13. In the electronic circuit unit 1 of the ground-based antenna device 100, the housing 7 is attached to the base plate 4 in a detachable manner, and the base plate 4 is securely fixed to the rear glass 51 with moisture curing resin 14 (see FIG. 3).

Each component of the ground-based antenna device 100 will be described in detail. The radiation conductor 2 is a conductor layer composed of highly-conductive metal, such as Ag. Referring to FIG. 3, the radiation conductor 2 is provided with a slot 2*a* having a predetermined dimension. Two segments of the radiation conductor 2 at opposite sides of the slot 2*a* function as electric feeding points connected with a first end portion of the feeder cable 5. Moreover, referring to the bottom view of FIG. 6, three sections of the radiation conductor 2 are soldered to corresponding soldering sections 4*a* of the base plate 4, such that the base plate 4 electrically functions as a ground.

The reflector plate 3 is a rectangular metal plate that extends from the base plate 4 at an angle and that faces the radiation conductor 2. The reflector plate 3 is used for reflecting radio-waves and thus contributes to achieving a higher gain at low elevation angles. A back surface of the reflector plate 3 is provided with an angle-maintaining member 15 which is fixed to the reflector plate 3 and a section of the base plate 4 adjacent to the reflector plate 3 in a caulked manner. The angle-maintaining member 15 is formed by punching a metal plate into a predetermined shape and then bending the metal plate, and is provided with a pair of contact edges 15*a* for setting the positional relationship between the back surface of the reflector plate 3 and a flat surface of the base plate 4 in a relatively desired manner. Specifically, the contact edges 15*a* extend from the flat surface of the base plate 4 and along the back surface of the reflector plate 3, and are lines that are cut with high dimensional accuracy during the punching process of the angle-maintaining member 15. Due to the fact that the pair of contact edges 15*a* with high dimensional accuracy abuts on the flat surface of the base plate 4 and the back surface of the reflector plate 3, the angle of inclination of the reflector plate 3 can be set in a highly accurate manner with respect to the base plate 4. Furthermore, the angle-maintaining member 15 is also provided with a pair of erect portions 15*b* which face each other and extend along the respective contact edges 15*a*. The erect portions 15*b* are formed by bending two opposite segments of the metal plate at a substantially right angle in a direction in which the two contact edges 15*a* are opposed to each other. The angle-maintaining member 15 increases the mechanical strength of the reflector plate 3 and thus prevents undesired deformation of the reflector plate 3.

In addition to the three soldering sections 4*a*, the base plate 4 is also provided with two internal-thread portions 4*b*. Furthermore, referring to FIG. 6, the central part of each soldering section 4*a* is provided with a semispherical protrusion 4*c* that protrudes towards the radiation conductor 2. Each of the protrusions 4*c* abuts on the radiation conductor 2 such that a solder-accumulation space is formed around the protrusion 4*c*. Moreover, the peripheries of the soldering sections 4*a* are correspondingly provided with cutout sections 4*d* each having, for example, an L-shape, I-shape, or circular shape. This forms narrow sections 4*e* that connect the soldering sections 4*a* and other sections of the base plate 4. Accordingly, during a heating process for soldering the soldering sections 4*a* to the radiation conductor 2, the heat applied is less likely to be transmitted to the other undesired sections, whereby the soldering process can be performed efficiently in a small amount of time.

Furthermore, the base plate 4 is also provided with a plurality of height-adjustment portions 4*f* at positions distant from the soldering sections 4*a* such that these height-adjustment portions 4*f* protrude towards the rear glass 51. The height-adjustment portions 4*f* have a semispherical shape with substantially the same dimension as the protrusions 4*c*. Consequently, the base plate 4 faces the rear glass 51 in a point-contact fashion, thereby ensuring the protrusions 4*c* of the soldering sections 4*a* to abut on the radiation conductor 2 during the attachment process of the base plate 4. This prevents undesirable rising of the base plate 4. Referring to FIG. 3, in a state where the base plate 4 is fixed to the rear glass 51 via the moisture curing resin 14, the soldering sections 4*a* are soldered to the radiation conductor 2 during the attachment process of the base plate 4. Therefore, it is not necessary to temporarily fix the base plate 4 using, for example, a double-side adhesive tape while waiting for the moisture curing resin 14 to harden.

Furthermore, referring to FIGS. 3, 4, and 6, the base plate 4 is provided with a pair of supporting segments 4*g* projected towards the interior of the frame body 10. In a state where the base plate 4 is fixed to the rear glass 51, the pair of supporting segments 4*g* faces the rear glass 51 and is separated from the rear glass 51 by a predetermined distance. This allows the feeder cable 5 to be sandwiched between the rear glass 51 and the supporting segments 4*g* so as to achieve proper positioning of the feeder cable 5. Moreover, the base plate 4 is further provided with a hook segment 4*h* which protrudes outward of the frame body 10. In a state where the base plate 4 is fixed to the rear glass 51, the hook segment 4*h* is separated from the rear glass 51 by a distance much greater than the distance separating the supporting segments 4*g* from the rear glass 51. Consequently, the feeder cable 5 extending towards the exterior of the frame body 10 can be hooked to the hook segment 4*h*, thereby achieving proper positioning of the feeder cable 5.

The first end portion of the feeder cable 5 soldered to the electric feeding points of the radiation conductor 2 extends parallel to the inner surface of the rear glass 51 towards the exterior of the frame body 10. Since this parallel-extending portion of the feeder cable 5 is positioned by the pair of supporting segments 4*g* and the rear glass 51 by being sandwiched therebetween, this portion of the feeder cable 5 above the rear glass 51 can extend efficiently along a predetermined path. On the other hand, since the feeder cable 5 extending outward from the frame body 10 can be positioned readily by hooking the feeder cable 5 onto the hook segment 4*h*, the feeder cable 5 can also extend efficiently adjacent to the exterior of the frame body 10. Referring to FIG. 4, a second end portion of the feeder cable 5 has a connector 16 attached thereto. The connector 16 is connected with a connector 17 disposed on the circuit substrate 6 and facing the opening 11*a* of the cover 11, such that the second end portion of the feeder cable 5 is connected with an input section of a pre-amplifying circuit.

As shown in FIG. 4, the frame body 10 mainly includes a pair of side walls 10*b*, 10*c* facing each other, and a pair of side walls 10*d*, 10*e* facing each other. Each of the side walls 10*d*, 10*e* is provided with one of the projection tabs 10*a* which are louver tabs. The side wall 10*d* is provided with an arm segment 10*f* extending outward from one longitudinal end of the side wall 10*d*. Referring to FIG. 7, the frame body 10 includes a large-dimension body part 10A which is adjacent to the cover 11 and is shown at an upper side of the drawing. The large-dimension body part 10A has a dimension larger than that of a body part adjacent to the base plate 4, which is shown at a lower side of the drawing. Specifically, one longitudinal side of each of the side walls 10*d*, 10*e* is given a bulging segment, and the side wall 10*c* is bent in a staircase manner. Thus, an opening of the frame body 10 adjacent to the cover 11 is given a larger dimension, such that one side of the large-dimension body part 10A bulges towards the reflector plate 3. In view of the fact that the circuit substrate 6 is housed in the large-dimension body part 10A, a sufficiently large installation space for the circuit substrate 6 can be obtained in the frame body 10 without increasing the overall size of the frame body 10 and also without positioning a section of the frame body 10 in a region where the frame body 10 could possibly interfere with the operation of the reflector plate 3. Furthermore, in the large-dimension body part 10A, the side walls 10*b* to 10*e* are each provided with a plurality of small holes 10*h* (see FIG. 4).

By fastening the setscrews 13 extending through the corresponding projection tabs 10*a* to the corresponding internal-thread portions 4*b*, the frame body 10 is secured to the base plate 4 preliminarily fixed on the rear glass 51. Referring to FIG. 1A, the rear glass 51 is a windowpane installed in the vehicle 50 at an angle with respect to the ground. When the frame body 10 is fixed to the rear glass 51 via the base plate 4, the side wall 10*b* defines a lower region disposed closer to the ground. Consequently, referring to FIG. 8, the side wall 10*b* is provided with two circular drainage holes 10*i* which allow an internal space defined by the base plate 4, the rear glass 51, the frame body 10, and the undersurface of the circuit substrate 6 to communicate with the external space. Specifically, the drainage holes 10*i* allow water droplets entering the internal space to be drained outward quickly so as to prevent water from accumulating in the internal space. Furthermore, the side wall 10*b* of the frame body 10 is also provided with a clearance recess 10*j* at a position adjacent to the hook segment 4*h* of the base plate 4 so that the feeder cable 5 can extend outward.

The arm segment 10*f* extending from the side wall 10*d* of the frame body 10 is provided for holding the coaxial cable 8. The arm segment 10*f* is provided with a cutout notch 10*g* whose opening side is relatively narrower. By press-fitting a heat shrinkable tube 18 wrapped around the coaxial cable 8 into the cutout notch 10*g*, the coaxial cable 8 can be engaged to the arm segment 10*f* in a single-step fashion, and moreover, the inner conductor and the outer conductor of the coaxial cable 8 can be securely protected. Accordingly, this achieves a stable orientation of the coaxial cable 8 during the assembly process, and also prevents the connecting section of the coaxial cable 8 from being damaged in a case where a pulling force acts upon the coaxial cable 8. Furthermore, by changing the metallic arm segment 10*f* into a desired shape, the orientation of the coaxial cable 8 can be readily corrected.

Referring to FIG. 4, one surface of the circuit substrate 6 defines a component-holding surface 6*a* on which various types of electronic components (not shown) are mounted. Via the connectors 16 and 17, the component-holding surface 6*a* is connected to the second end portion of the feeder cable 5, whose first end portion is connected with the radiation conductor 2. In other words, the second end portion of the feeder cable 5 is connected with the input section of the pre-amplifying circuit. Furthermore, the component-holding surface 6*a* has one end of each of the coaxial cable 8 and the DC cable 9 soldered thereto. The other end of the coaxial cable 8 has a connector 19 attached thereto. Multiple peripheral sections of the component-holding surface 6*a* are soldered to the frame body 10. Accordingly, the frame body 10 electrically functions as a ground, and moreover, the circuit substrate 6 and the frame body 10 are mechanically joined with each other.

The cover 11 is provided with the opening 11*a* which is to be covered by the connector cover 12. Since the connector 17 faces the opening 11*a*, the connector 16 of the feeder cable 5 can be connected to the connector 17 of the circuit substrate 6 in a state where the frame body 10 holding the circuit substrate 6 is capped with the cover 11. The cover 11 is provided with bent segments 11*b* substantially around the entire peripheral region of the cover 11. The bent segments 11*b* fit around the side walls 10*b* to 10*e* of the frame body 10 and are provided with a plurality of engagement protrusions 11*c* that protrude inward. The engagement protrusions 11*c* are provided at positions corresponding to the small holes 10*h* of the frame body 10. The resilience of the bent segments 11*b* allows the engagement protrusions 11*c* to be press-fitted into the corresponding small holes 10*h*. Consequently, the cover 11 can be readily engaged to the frame body 10 in a snap-fit fashion. Since the circuit substrate 6 is installed in the frame body 10 before the engagement process of the cover 11, the installation process of the circuit substrate 6 is simplified.

Referring to FIG. 8, the cover 11 is further provided with a supporting notch 11*e* in one of the bent segments 11*b* proximate the opening 11*a*. The supporting notch 11*e* is provided for holding the end portion of the feeder cable 5 proximate the connector 16 so as to achieve proper positioning of the feeder cable 5. Thus, the feeder cable 5 extending outward via the hook segment 4*h* can be readily and properly positioned in the opening 11*a*. Moreover, since the opening side of the supporting notch 11*e* is closed when the connector cover 12 is attached to the cover 11, the feeder cable 5 is prevented from being disengaged from the supporting notch 11*e*.

When the frame body 10 capped with the cover 11 is fixed to the rear glass 51 via the base plate 4, a region of the cover 11 proximate the side wall 10*b* of the frame body 10 defines a lower region disposed closer to the ground. Consequently, the lower region of the cover 11 is provided with two rectangular drainage holes 11*d*. The drainage holes 11*d* allow water droplets entering an internal space defined by the component-holding surface 6*a* of the circuit substrate 6, the frame body 10, the cover 11, and the connector cover 12 to be drained outward quickly so as to prevent water from accumulating in the internal space.

An assembly process of the ground-based antenna device 100 described above will now be described. Firstly, the radiation conductor 2 is formed on an inner surface of a sheet of glass constituting the rear glass 51. Subsequently, the first end portion of the feeder cable 5 is soldered to the electric feeding points of the radiation conductor 2, and the soldering sections 4*a* of the base plate 4 are soldered to predetermined positions of the radiation conductor 2. In this case, the first end portion of the feeder cable 5 is positioned by the supporting segments 4*g* of the base plate 4 and the sheet of glass by being sandwiched therebetween. Moreover, the moisture curing resin 14 is preliminarily applied to the bottom surface of the base plate 4. Secondly, the frame body 10 is fixed to the internal-thread portions 4*b* of the base plate 4 via the setscrews 13. Here, the circuit substrate 6 is preliminarily installed in the frame body 10; the ends of the coaxial cable 8 and the DC cable 9 are preliminarily soldered on the circuit substrate 6; and the cover 11 is preliminarily engaged with the frame body 10. Moreover, when the frame body 10 is to be screwed onto the base plate 4, the feeder cable 5 is pulled toward the exterior of the frame body 10 via the clearance recess 10*j* of the side wall 10*b*. Thirdly, after fixing the frame body 10 to the base plate 4, the feeder cable 5 hooked on the hook segment 4*h* is pulled into the opening 11*a* of the cover 11 via the supporting notch 11*e*. Fourthly, the connector 16 attached to the second end portion of the feeder cable 5 is connected to the connector 17 of the circuit substrate 6 facing the opening 11*a*. Subsequently, the connector cover 12 is mounted on the cover 11 so as to cover the opening 11*a*, whereby an attachment process for attaching the electronic circuit unit 1 to the sheet of glass constituting the rear glass 51 is completed.

The satellite antenna device 200 will now be described. The satellite antenna device 200 is a patch antenna device and mainly includes the electronic circuit unit 21 attached to the inner surface of the rear glass 51 facing the inside of the vehicle 50, and the radiation conductor 22 and a ground conductor 23 disposed on the inner surface of the rear glass 51. The electronic circuit unit 21 includes the base plate 24 formed of a sheet metal, which is fixed on the inner surface of the rear glass 51; a circuit substrate 26 electrically connected with the radiation conductor 22 and the ground conductor 23 via a coaxial feeder cable 25; a sheet-metal housing 27 that houses the circuit substrate 26 and is attached to the base plate 24; a coaxial cable (input-output cable) 28 whose first end is connected to the circuit substrate 26 and whose second end is connected to an external receiving unit (not shown); and the DC cable 9 for supplying the ground-based antenna device 100 with power.

The housing 27 includes a sheet-metal rectangular frame body 30 that surrounds and supports the circuit substrate 26; a sheet-metal cover 31 that is engaged with the frame body 30 so as to cover the circuit substrate 26; and a sheet-metal connector cover 32 for covering an opening 31*a* of the cover 31. Multiple sections of the frame body 30 are fixed to the base plate 24 via setscrews 33. In the electronic circuit unit 21 of the satellite antenna device 200, the housing 27 is attached to the base plate 24 in a detachable manner, and the base plate 24 is securely fixed to the rear glass 51 with moisture curing resin 34 (see FIG. 10).

Each component of the satellite antenna device 200 will be described in detail. Referring to FIG. 10, the radiation conductor 22 is a substantially rectangular patch electrode whose opposite corners with respect to a diagonal line are provided with cutout degeneracy-splitting elements 22*a*. On the other hand, the ground conductor 23 is a frame-like ground electrode that surrounds the radiation conductor 22 in a manner such that the ground conductor 23 and the radiation conductor 22 are separated by a predetermined distance. The radiation conductor 22 and the ground conductor 23 are conductor layers composed of highly-conductive metal, such as Ag. As shown in FIG. 10, an electric feeding point of the radiation conductor 22 is connected with an inner conductor of the feeder cable 25. On the other hand, the ground conductor 23 is connected with an outer conductor of the feeder cable 25.

The base plate 24 has a rectangular shape with an opening 24*a*, and is provided with internal-thread portions 24*b* at multiple positions. By fastening the setscrews 33 extending through corresponding projection tabs 30*a* of the frame body 30 to the corresponding internal-thread portions 24*b*, the frame body 30 is secured to the base plate 24. As shown in FIG. 10, the base plate 24 is fixed to the rear glass 51 with the moisture curing resin 34 and double-side adhesive tapes 35. The double-side adhesive tapes 35 function as temporarily fixing means while waiting for the moisture curing resin 34 to harden.

Referring to FIG. 11, the rectangular frame body 30 mainly includes a pair of side walls 30*b*, 30*c* facing each other, and a pair of side walls 30*d*, 30*e* facing each other. Opposite longitudinal ends of each of the side walls 30*b*, 30*c* are provided with the corresponding projection tabs 30*a*. A portion of the frame body 30 facing the rear glass 51 defines an engagement portion 30*f* that loosely fits in the opening 24*a* of the base plate 24. Four corners of the engagement portion 30*f* are provided with stoppers 30*g*. The stoppers 30*g* are placed on sections of the base plate 24 that are adjacent to the opening 24*a*. Thus, the stoppers 30*g* at the four corners of the engagement portion 30*f* abut on the base plate 24 such that the amount of insertion of the engagement portion 30*f* with respect to the opening 24*a* is set within the thickness of the base plate 24. Each of the side walls 30*b*, 30*c* is provided with a pair of the stoppers 30*g* respectively at opposite longitudinal ends thereof, such that each stopper 30*g* is projected slightly outward with respect to the adjacent side wall 30*d* or 30*e*. Furthermore, a portion of the frame body 30 opposite to the engagement portion 30*f* is provided with a plurality of small holes 30*h*.

Referring to FIG. 1A, since the rear glass 51 is a windowpane installed in the vehicle 50 at an angle with respect to the ground, when the frame body 30 is fixed to the rear glass 51 via the base plate 24, the side wall 30*b* defines a lower region disposed closer to the ground. Consequently, referring to FIG. 14, the side wall 30*b* is provided with two circular drainage holes 30*i* which allow an internal space to communicate with the external space. Furthermore, each of the side walls 30*b* to 30*e* of the frame body 30 is provided with tongue pieces 30*j* bent toward the internal space, and clearance holes 30*k* necessary for forming the corresponding tongue pieces 30*j*. The bent tongue pieces 30*j* support the circuit substrate 26. The drawings other than FIG. 11 illustrate a state where the tongue pieces 30*j* are not bent. The clearance holes 30*k* provided in the side wall 30*b* also function as drainage holes. The drainage holes 30*i* and the clearance holes 30*k* functioning also as drainage holes allow water droplets entering an internal space defined by the rear glass 51, the frame body 30, and the undersurface of the circuit substrate 26 (i.e. a radio-wave reflective surface 26*b*) to be drained outward quickly so as to prevent water from accumulating in the internal space.

As shown in FIG. 11, one surface of the circuit substrate 26 defines a component-holding surface 26*a* on which various types of electronic components (not shown) are mounted. Via a pair of connectors 36, 37, the component-holding surface 26*a* is connected to a second end portion of the feeder cable 25, whose first end portion is connected with the radiation conductor 22 and the ground conductor 23. In other words, the second end portion of the feeder cable 25 is connected with an input section of a pre-amplifying circuit. Furthermore, the component-holding surface 26*a* has one end of each of the coaxial cable 28 and the DC cable 9 soldered thereto. The other end of the coaxial cable 28 has a connector 38 attached thereto. Multiple peripheral sections of the component-holding surface 26*a* are soldered to the frame body 30. Accordingly, the frame body 30 electrically functions as a ground, and moreover, the circuit substrate 26 and the frame body 30 are mechanically joined with each other. The other surface (undersurface) of the circuit substrate 26, that is, a surface facing the radiation conductor 22 and the ground conductor 23, constitutes the radio-wave reflective surface 26*b* (see FIG. 13), which is a conductor layer composed of highly-conductive metal, such as Au. The peripheral region of the radio-wave reflective surface 26*b* is supported by the tongue pieces 30*j* of the frame body 30 at multiple positions.

The cover 31 is provided with the opening 31*a* which is to be covered by the connector cover 32. Since the connector 37 faces the opening 31*a*, the connector 36 of the feeder cable 25 can be connected to the connector 37 of the circuit substrate 26 in a state where the frame body 30 holding the circuit substrate 26 is capped with the cover 31. The cover 31 is provided with bent segments 31*b* substantially around the entire peripheral region of the cover 31. The bent segments 31*b* fit around the side walls 30*b* to 30*e* of the frame body 30 and are provided with a plurality of engagement protrusions 31*c* that protrude inward. The engagement protrusions 31*c* are provided at positions corresponding to the small holes 30*h* of the frame body 30. The resilience of the bent segments 31*b* allows the engagement protrusions 31*c* to be press-fitted into the corresponding small holes 30*h*. Consequently, the cover 31 can be readily engaged to the frame body 30 in a snap-fit fashion. Since the circuit substrate 26 is installed in the frame body 30 before the engagement process of the cover 31, the installation process of the circuit substrate 26 is simplified.

When the frame body 30 capped with the cover 31 is fixed to the rear glass 51 via the base plate 24, a region of the cover 31 proximate the side wall 30*b* of the frame body 30 defines a lower region disposed closer to the ground. Consequently, the lower region of the cover 31 is provided with four rectangular drainage holes 31*d*. The drainage holes 31*d* allow water droplets entering an internal space defined by the component-holding surface 26*a* of the circuit substrate 26, the frame body 30, the cover 31, and the connector cover 32 to be drained outward quickly so as to prevent water from accumulating in the internal space.

An assembly process of the satellite antenna device 200 described above will now be described. Firstly, the radiation conductor 22 and the ground conductor 23 are formed on the inner surface of the sheet of glass constituting the rear glass 51. The first end portion of the feeder cable 25 is then soldered to predetermined positions of the radiation conductor 22 and the ground conductor 23. Secondly, the base plate 24 is securely fixed to the inner surface of the sheet of glass by using, for example, the moisture curing resin 34. The engagement portion 30*f* of the frame body 30 is then inserted into and positioned within the opening 24*a*. Subsequently, the frame body 30 is fixed to the internal-thread portions 24*b* of the base plate 24 via the setscrews 33. Here, the circuit substrate 26 is preliminarily installed in the frame body 30; the ends of the coaxial cable 28 and the DC cable 9 are preliminarily soldered on the circuit substrate 26; and the cover 31 is preliminarily engaged with the frame body 30. Moreover, when the frame body 30 is to be screwed onto the base plate 24, the feeder cable 25 is pulled toward the exterior of the frame body 30 via a clearance recess 30*m* (see FIG. 11) provided in the side wall 30*d*. Thirdly, after fixing the frame body 30 to the base plate 24, the connector 36 attached to the second end portion of the feeder cable 25 is connected to the connector 37 of the circuit substrate 26 facing the opening 31*a* of the cover 31. Subsequently, the connector cover 32 is mounted on the cover 31 so as to cover the opening 31*a*, whereby an attachment process for attaching the electronic circuit unit 21 to the sheet of glass constituting the rear glass 51 is completed.

The unique advantages of the above embodiment will be described below in detail. The unique advantages of the ground-based antenna device 100 will be described first. In detail, due to the fact that the connecting sections between the soldering sections 4*a* and the other sections of the base plate 4 are defined by the narrow sections 4*e*, these other sections of the base plate 4 do not receive much heat during the heating process for soldering the base plate 4 to the radiation conductor 2. Consequently, the soldering process can be completed within a small amount of time. Furthermore, each of the soldering sections 4*a* is provided with one of the protrusions 4*c* such that a solder-accumulation space is formed around the protrusion 4*c*. This prevents strength reduction caused by a lack of solder in the soldering sections 4*a*, whereby a highly reliable solder connection is achieved.

Furthermore, in the ground-based antenna device 100, the back surface of the reflector plate 3 is provided with the angle-maintaining member 15. Specifically, due to the fact that the contact edges 15*a* with high dimensional accuracy are in contact with the back surface of the reflector plate 3 and the flat surface of the base plate 4, the angle of inclination of the reflector plate 3 is set in a highly accurate manner with respect to the sheet of glass (rear glass) 51. Accordingly, a desired antenna performance can be achieved. Moreover, the angle-maintaining member 15 significantly improves the mechanical strength of the reflector plate 3, and thus reduces the possibility of the reflector plate 3 deforming into an undesired shape in response to receiving an external force during, for example, the assembly process. Accordingly, this further contributes to higher reliability in view of strength.

Furthermore, in the ground-based antenna device 100, the first end portion of the feeder cable 5 connected to the electric feeding points of the radiation conductor 2 is positioned by the supporting segments 4*g* and the sheet of glass (rear glass) 51 by being sandwiched therebetween, and moreover, the feeder cable 5 extending adjacent to the exterior of the housing 7 is positioned by the hook segment 4*h* and the supporting notch 11*e*. Accordingly, the feeder cable 5 can extend efficiently along a predetermined path.

Furthermore, in the ground-based antenna device 100, the coaxial cable 8 is held by the arm segment 10*f* extending from the frame body 10. This achieves a stable orientation of the coaxial cable 8 during the assembly process, and also prevents the connecting section of the coaxial cable 8 from being damaged in a case where a pulling force acts upon the coaxial cable 8. Moreover, by changing the metallic arm segment 10*f* into a desired shape, the orientation of the coaxial cable 8 can be readily corrected. Accordingly, the fixing process of the coaxial cable 8 can be performed in an extremely simple manner without using, for example, binders and adhesive tapes.

Furthermore, in the ground-based antenna device 100, the frame body 10 housing the circuit substrate 6 is screwed on the base plate 4 that is preliminarily fixed on the sheet of glass (rear glass) 51. This eliminates the need for performing complicated processes, such as demounting and remounting processes, when the circuit substrate 6 is to be inspected or replaced with a new one, and thus allows for easier maintenance.

Furthermore, in the ground-based antenna device 100, the frame body 10 and the cover 11 included in the housing 7 are respectively provided with the drainage holes 10*i* and the drainage holes 11*d*. Since the drainage holes 10*i*, 11*d* are provided at the bottommost portion of the electronic circuit unit 1 attached to the rear glass 51 that is disposed at an angle with respect to the ground, the component-holding surface 6*a* of the circuit substrate 6 is prevented from being immersed in water even when water droplets enter the internal space of the housing 7. Accordingly, a malfunction and failure caused by intrusion of water droplets are less likely to occur in the ground-based antenna device 100 such that high reliability is guaranteed over a long period of time.

Next, the unique advantages of the satellite antenna device 200 will be described. In detail, since the undersurface of the circuit substrate 26 constitutes the radio-wave reflective surface 26*b* that faces the radiation conductor 22 and the ground conductor 23, a higher radiation gain can be attained in the incoming direction of a tuned radio-wave. In view of the fact that the height of the radio-wave reflective surface 26*b* must be set accurately with respect to the radiation conductor 22 and the ground conductor 23, since the frame body 30 housing the circuit substrate 26 according to the above embodiment is positioned properly in the planar direction of the base plate 24 via the engagement portion 30*f* and in the thickness direction of the base plate 24 via the stoppers 30*g*, the circuit substrate 26 is automatically disposed at a predetermined position when the frame body 30 is mounted onto the base plate 24. This means that the height of the circuit substrate 26 is set accurately with respect to the radiation conductor 22, and moreover, prevents an undesired gap from being formed between the frame body 30 and the base plate 24. In other words, since the electronic circuit unit 21 of the satellite antenna device 200 is an assembly structure in which the height of the radio-wave reflective surface 26*b* is set in a highly accurate manner, a high antenna performance is guaranteed. Moreover, since the frame body 30 can be fabricated easily due to having a simple structure, the dimensional accuracy of the engagement portion 30*f* and the stoppers 30*g* can be readily improved.

Furthermore, similar to the ground-based antenna device 100, the satellite antenna device 200 is advantageous in that the frame body 30 and the cover 31 included in the housing 27 are respectively provided with the drainage holes 30*i* and the clearance holes 30*k*, functioning also as drainage holes, and the drainage holes 31*d*. Since the drainage holes 30*i*, 31*d* and the clearance holes 30*k* are provided at the bottommost portion of the electronic circuit unit 21 attached to the rear glass 51 that is disposed at an angle with respect to the ground, the component-holding surface 26*a* and the radio-wave reflective surface 26*b* of the circuit substrate 26 are prevented from being immersed in water even when water droplets enter the internal space of the housing 27. Accordingly, a malfunction and failure caused by intrusion of water droplets are less likely to occur in the satellite antenna device 200 such that high reliability is guaranteed over a long period of time.

Furthermore, similar to the ground-based antenna device 100, the satellite antenna device 200 is advantageous in that the frame body 30 housing the circuit substrate 26 is screwed on the base plate 24 that is preliminarily fixed on the sheet of glass (rear glass) 51. This eliminates the need for performing complicated processes, such as demounting and remounting processes, when the circuit substrate 26 is to be inspected or replaced with a new one, and thus allows for easier maintenance.

Although the above embodiment describes an in-vehicle antenna apparatus in which the ground-based antenna device 100 and the satellite antenna device 200 are arranged in a side-by-side manner and operate in a mutually complementary manner, the present invention is not limited to such a structure. For example, the scope of the present invention may include an in-vehicle antenna apparatus provided with only one of the two antenna devices. Furthermore, the in-vehicle antenna apparatus may alternatively be mounted on, for example, the front glass of the vehicle instead of the rear glass.

What is claimed is:

1. An in-vehicle antenna apparatus comprising a sheet of glass serving as a windowpane installed in a vehicle; a radiation conductor disposed on an inner surface of the sheet of glass facing an inside of the vehicle; a sheet-metal base plate having an opening and fixed on the inner surface of the sheet of glass; a circuit substrate whose first surface faces the radiation conductor and is provided with a conductor layer and whose second surface defines a component-holding surface electrically connected with the radiation conductor; and a sheet-metal housing which houses the circuit substrate and is attached to the base plate, the circuit substrate being disposed between the sheet-metal base plate and the sheet-metal housing, wherein a section of the housing proximate the sheet of glass includes an engagement portion that loosely fits in the opening; and stoppers placed on sections of the base plate that are adjacent to the opening, the stoppers abutting on the base plate such that an amount of insertion of the engagement portion with respect to the opening is set within a thickness of the base plate.

2. The in-vehicle antenna apparatus according to claim 1, wherein the housing includes a rectangular frame body that surrounds and supports the circuit substrate and that is fixed to the base plate in a detachable manner; and a cover that engages with the frame body so as to cover the circuit substrate, and wherein each of four corners of the frame body is provided with one of the stoppers.

3. The in-vehicle antenna apparatus according to claim 2, wherein longitudinal ends of two facing side walls of the frame body are provided with the stoppers, the stoppers being projected slightly outward with respect to side walls adjacent to the two facing side walls.

4. An in-vehicle antenna apparatus comprising a sheet of glass serving as a windowpane installed in a vehicle; a radiation conductor disposed on an inner surface of the sheet of glass facing an inside of the vehicle; a sheet-metal base plate having an opening and fixed on the inner surface of the sheet of glass; a circuit substrate whose first surface faces the radiation conductor and is provided with a conductor layer and whose second surface defines a component-holding surface electrically connected with the radiation conductor; and a sheet-metal housing which houses the circuit substrate and is attached to the base plate, wherein a section of the housing proximate the sheet of glass includes an engagement portion that fits in an inner side of the opening; and stoppers placed on sections of the base plate that are adjacent to the opening, the stoppers abutting on the base plate such that an amount of insertion of the engagement portion with respect to the opening is set within a thickness of the base plate.

* * * * *